United States Patent [19]

Osaki

[11] 3,993,009

[45] Nov. 23, 1976

[54] PRESSER FOOT SEWING MACHINES

[75] Inventor: Tatsuo Osaki, Uozu, Japan

[73] Assignee: Yoshida Kogyo Kabushiki Kaisha, Tokyo, Japan

[22] Filed: Oct. 9, 1975

[21] Appl. No.: 620,935

[30] Foreign Application Priority Data

Oct. 12, 1974 Japan ..... 49-117259

[52] U.S. Cl. ..... 112/235

[51] Int. Cl.[2] ..... D05B 29/00

[58] Field of Search..... 112/235, 265, 104, 236–240

[56] References Cited

UNITED STATES PATENTS

| | | | |
|---|---|---|---|
| 3,318,273 | 5/1967 | Eddy | 112/235 |
| 3,854,432 | 12/1974 | Howell | 112/235 |
| 3,858,539 | 1/1975 | Van Amburg | 112/235 |

*Primary Examiner*—G. V. Larkin

*Attorney, Agent, or Firm*—Hill, Gross, Simpson, Van Santen, Steadman, Chiara & Simpson

[57] ABSTRACT

A presser foot, for a sewing machine for use in sewing slide fasteners to garments, has a foot portion pivotally mounted on a vertically movable presser bar of the sewing machine, gripping members pivotally mounted on the foot portion and cooperating with the latter in forming guide grooves for receiving and guiding element rows secured to the slide fastener tapes, and a spring member fixed to the foot portion and engaging with the gripping members to normally bias the latter toward the foot portion in a direction to narrow the guide grooves.

6 Claims, 4 Drawing Figures

PRESSER FOOT SEWING MACHINES

BACKGROUND OF THE INVENTION

1. Field of the Invention

This invention relates to presser feet for sewing machines and more particularly to an improved sewing machine foot for use in sewing slide fasteners to garments.

2. Prior Art

As is well known in the art, conventional presser feet of the type described were each provided in its lower face with a longitudinal groove or recess adapted to receive and guide a row of fastener elements mounted on a marginal edge of a stringer tape. Since however the grooves of the prior art presser feet have predetermined space dimensions such that the element rows can be guided slidably therethrough, they have suffered from the difficulty that the element rows slip down out of engagement with the grooves when the presser feet are lifted away from the feed plates of the sewing machines in order to mount the element rows in the presser foot grooves or insert the garments between the presser feet and the feed plates. A greater difficulty has been experienced with the so-called two-needle sewing machines which utilize such presser feet having a pair of element-guiding grooves and adapted for sewing simultaneously a pair of fastener stringers to each marginal edge of the opening in the garment. More specifically, putting the pair of tape-mounted element rows in place in the pair of grooves of the presser foot while the latter is being lifted, has to be done with both hands; that is, one element row is inserted into one of the pair of grooves using either the left or right hand, and then the other element row is mounted in the other foot groove by the other hand, during which time either of the two hands of the operator must be used to retain the previously inserted element row in engagement with the foot goove, so as to prevent the tape-carried element rows from being dropped out of the grooves of the presser foot. This element-insertion procedure is further complicated where the concealed type of slide fastener is sewn to the garment, since additional care must be taken to raise the tape-mounted element rows away from the surface of the stringer tape in order to insert the element rows into position in the presser foot grooves.

SUMMARY OF THE INVENTION

It is therefore an object of the present invention to provide an improved presser foot for use in sewing slide fasteners upon garments or the like which is capable of preventing rows of fastener elements mounted on stringer tapes from being disengaged from guide grooves in the presser foot when lifting the latter away from the feed plate of a sewing machine in order to put the garment or the element rows in place.

Another object of the invention is to provide a presser foot which will facilitate the fastener sewing operation.

With these objects in view, the invention provides a presser foot for sewing to a garment a slide fastener having two rows of fastener elements mounted on respective carrier tapes, comprising in combination a foot portion pivotally mounted on a presser bar, a gripping member mounted on said foot portion and cooperating with the latter in forming a guiding groove for receiving and guiding the tape-mounted element row, and a spring member secured to said foot portion and engaging with said gripping member to normally bias the latter toward said foot portion in a direction to narrow said guide groove.

The features which are believed to be novel and characteristic of this invention are set forth in particular in the appended claims. The invention itself, however, will be better understood from the following detailed description taken in connection with the accompanying drawings which illustrate by way of example certain preferred embodiments and in which like reference numerals or characters designate like parts throughout the several views.

DETAILED DESCRIPTION OF THE PREFERRED EMBODIMENTS

Figure 1:
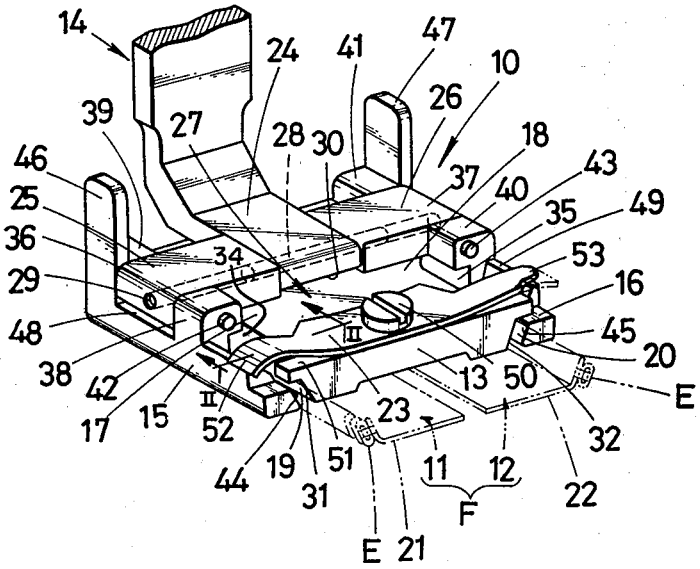
FIG. 1 is a perspective view of a presser foot constructed according to the invention.

In FIG. 1, there is shown a presser foot generally designated at 10 for use in sewing a pair of stringers 11 and 12 for a concealed type slide fastener F at and along the marginal edges of an opening in a garment (not shown). The presser foot 10 is herein shown for illustrative purposes to be used on a two-needle sewing machine and is suitable for handling concenaled slide fasteners. The presser foot 10 broadly comprises a foot portion 13 pivotally carried on a pin 28 on a vertically movable presser bar 14 extending downwardly from a sewing machine head (not shown), and a pair of parallel, elongated grippers or gripping members 15 and 16 pivotally mounted respectively on a pair of transverse ends 17 and 18 of the foot portion 13 and cooperating with the latter in forming respectively a pair of grooves 19 and 20 therebetween, each of which grooves serves as a guideway for one of the two rows of interlocking fastener elements E on a pair of carrier tapes 21 and 22 and extends the full length of the foot portion 13. A spring member 23 such as for example a leaf spring is secured to the foot portion 13 to normally urge the rippers 15 and 16 toward the foot portion 13, that is, in a direction to reduce or narrow the width of the grooves 19 and 20, as is described later.

The presser bar 14 has its bottom end bent at right angles to the general plane of the presser bar 14 to provide a horizontal coupling plate 24 which is sandwiched between a pair of transversely spaced coupling blocks 25 and 26 formed integral with or otherwise connected to an upper surface 27 of the foot portion 13. The coupling plate 24 is connected to the coupling blocks 25, 26 by means of the pin 28 disposed in a slit 29 extending through these coupling members in the transverse direction of the foot portion 13. The width of the coupling plate 24 is such that the latter when assembled is fitted loosely between the spaced-apart coupling blocks 25 and 26. The coupling plate 24 is smaller in thickness than the coupling blocks 25, 26 and has its top surface disposed substantially flush with that of each of the coupling blocks 25, 26 to provide a gap 30 between the coupling plate 24 and the foot portion upper surface 27, so that the foot portion 13 is movable pivotally about the transverse pin 28 to provide intimate sliding contact with the stringers 11, 12 during progressive sewing operation. The foot portion 13 is provided along its transverse ends 17 and 18 with a pair of parallel guide walls 31 and 32, respectively, which extend longitudinally of and throughout the entire length of the foot portion 13 and are slanted inwardly toward a sole 33 (FIG. 2) of the foot portion 13. There are also provided a pair of needle guide bores 34 and 35 extending vertically through the foot portion 13 and disposed adjacent the guide grooves 19 and 20, respectively, and adapted to receive sewing machine needles (not shown) as the latter move in a vertical sewing motion.

Each of the coupling blocks 25, 26 has a free end 36, 37 extending laterally beyond the adjacent transverse ends 17, 18 of the foot portion 13. Each of the elongated grippers 15 and 16 has a pair of upwardly extending projections 38, 39 and 40, 41, respectively, that are formed integrally therewith and spaced apart longitudinally from each other by a distance slightly larger than the transverse width of the coupling blocks 25, 26. The grippers 15 and 16 are pivotally mounted on the free ends 36 and 37 of the coupling blocks 25 and 26, respectively, by means of a pair of pins 42 and 43 which extend longitudinally, the pin 42 extending through the projections 38, 39 and the block free end 36, and the pin 43 extending through the projections 40, 41 and the block free end 37. A pair of inclined guide walls 44, 45 are formed on and extend the full length of the respective grippers 15 and 16. Thus, the gripper guide walls 44 and 45 can move toward and away from the guide walls 31 and 32, respectively. The gripper guide walls 44 and 45 extend longitudinally in parallel with and define with the foot portion guide walls 31 and 32 the afore-mentioned guide grooves 19 and 20. The guide grooves 19 and 20 are slightly flared in opposite directions with respect to the vertical plane through the longitudinal center axis of the foot portion 13, as shown in FIG. 1. Formed integral with and extending upwardly from the rear projections 39 and 40 are a pair of levers 46 and 47 for controlling the pivotal movement of the grippers 15 and 16 about the respective pins 42 and 43. For example, moving the lever 46 toward the presser bar 14 causes the gripper 15 to pivot about the pin 42 away from the foot portion guide wall 31, that is, in a direction to widen the element guide groove 19. The free ends 36 and 37 of the coupling blocks 25, 26 have respective undersurfaces (not shown) which serve as stops engageable with a pair of gripper shoulders 48 and 49 to prevent any excessive pivotal movement of the respective grippers 15 and 16 away from the foot portion guide walls 31 and 32.

Figure 2:
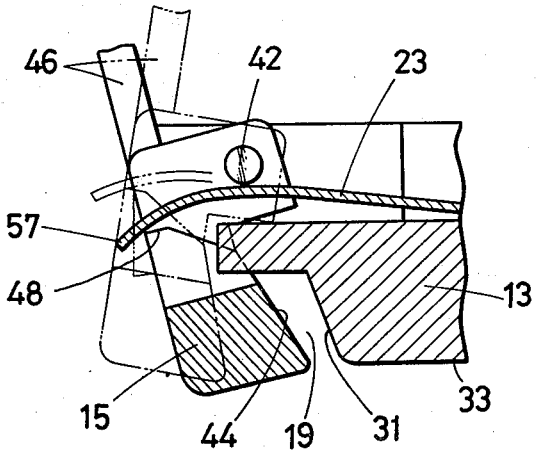
FIG. 2 is a fragmentary, transverse cross-sectional view, on an enlarged scale, of the presser foot shown in FIG. 1, taken along line II—II of FIG. 1, illustrating the manner in which the space of an element-guiding groove in the presser foot is held variable.

The leaf spring 23 is secured by a screw 50 centrally to a front marginal edge 51 of the foot portion upper surface 27 and has its ends 52 and 53 engaged with the gripper shoulders 48 and 49, respectively, to normally bias the gripprs 15 and 16 downwardly in a direction to move the gripper guide walls 44 and 45 toward the foot portion guide walls 31 and 32, respectively, or in a direction to narrow the guide grooves 19 and 20, as best seen in FIG. 2. The ends 52 and 53 of the leaf spring 23 extend outwardly slightly beyond the respective grippers 15 and 16 so that when the grippers 15 and 16 are pivoted, the spring ends 52 and 53 are prevented from departing from the gripper shoulders 48 and 49, respectively. The bias of the leaf spring 23 should be great enough to just enable the grippers 15 and 16 to grip and retain the tape-mounted elements E stably in position when the presser foot 10 is lifted, and to allow the gripped elements E to move smoothly through the guide grooves 19 and 20 as the sewing operation progresses.

Figure 3:
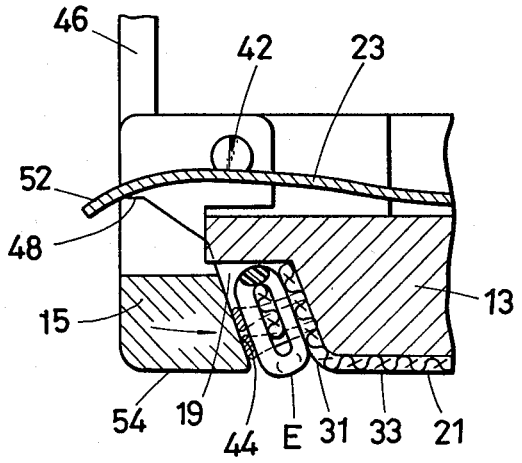
FIG. 3 is a view similar to FIG. 2 but showing the guiding groove receiving therein a fastener element mounted on a marginal edge of a stringer tape.

With the presser foot 10 lifted, one of the gripper levers, for example the gripper lever 46, is given a push inwardly toward the presser bar 14 to move the gripper 15 into the position shown by two-dot-dash lines in FIG. 2 against the biasing force of the leaf spring 23 so as to widen the guide groove 19, whereupon one of the rows of fastener elements E, herein shown for example to be in the form of coil structure, mounted on the marginal edge of the carrier tape 21 is inserted into position in the guide groove 19. Then, the gripper lever 46 is released and the gripper 15 is pivoted about the pin 42 in the direction of the arrow, or counterclockwise as viewed in FIG. 3 under the influence of the leaf spring 23 so as to grip the fastener elements E on the carrier tape 21 between the guide walls 44 and 31. Thereafter, the other row of fastener elements E mounted on the carrier tape 22 is fitted into the guide groove 20 in a similar manner. As shown in FIG. 3, the gripper 15 (16) has a bottom surface 54 located below or downwardly beyond the level of the sole 33 of the foot portion 13. The distance of projection of the gripper bottom surface 54 beyond the level of the foot portion sole 33 coresponds substantially to the thickness of the carrier tape 21. Thus, during progressive sewing operation the gripper bottom surface 54 is held in direct sliding contact with the surface of the garment so as to depress the latter.

Figure 4:
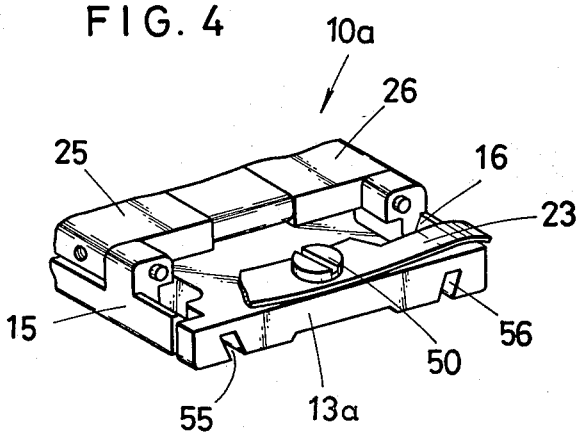
FIG. 4 is a fragmentary perspective view, with parts broken away, of a modification according to the invention.

FIG. 4 shows a modified presser foot 10*a* in which the foot portion 13*a* is provided at its front end with a pair of guide slots 55 and 56 which are formed in registration and communicate with the afore-mentioned expansible guide grooves 19 and 20, respectively. According to this modification, the fastener stringers 11, 12 can be guided in a relatively stable manner during fastener attaching and sewing operations.

With this structure, the rows of fastener elements E on the carrier tapes 21, 22 are prevented from slipping down out of engagement with the respective guide grooves 19, 20 in response to a force from the leaf spring 23 which urges te gripper guide walls 44, 45 toward the foot guide walls 31, 32, respectively. Advantageously, the spring-biased grippers 15, 16 can be resiliently displaced about the respective pins 42, 43 in conformity with the marginal tape edge portions, regardless of whether or not the latter carry the element rows and hence they can grip the marginal edge portions of the carrier tapes 21 and 22 which are devoid of the fastener elements E. Thus, the element-free marginal edge portions and element-carrying marginal edge portions of the carrier tapes 21, 22 can be sewn continuously to the garment provided the element-free portions are positioned adjacent the needle guide bores 34, 35.

Although preferred embodiments have been described for illustrative purposes only, it should be understood that variations or modifications thereof which come within the scope of the appended claims are fully contemplated. For example, a leaf spring of another shape or a coil spring may be provided in a suitable position instead of using the disclosed leaf spring 23 in order to bias the grippers 15, 16 toward the foot portion 13. Furthermore, the presser foot 10 or 10*a* of the present invention may be applied to a single needle sewing machine or to various types of slide fastener other than the concealed slide fastener which has been disclosed.

What is claimed is:

1. A presser foot for sewing to a garment a slide fastener having two rows of fastener elements mounted on respective carrier tapes, comprising in combination:

a. a foot portion pivotally mounted on a presser bar;

b. a gripping member mounted on said foot portion and cooperating with the latter in forming a guiding groove for receiving and guiding one of the rows of tape-mounted fastener elements; and c. a spring member secured to said foot portion and engaging with said gripping member to normally bias the latter toward said foot portion in a direction to narrow said guide groove.

2. A presser foot as defined in claim 1, wherein said foot portion is provided with a guide slot formed in registration and communicating with said guide groove.

3. A presser foot as defined in claim 1, wherein said spring member is a leaf spring having its free end engaged with said gripping member.

4. A presser foot as defined in claim 1, wherein said guide groove is flared with respect to the vertical central axis of said foot portion.

5. A presser foot as defined in claim 1, wherein said gripping member is provided with a lever for use in moving said gripping member away from the foot portion against the resiliency of said spring member.

6. A presser foot according to claim 1 including a second gripping member mounted on said foot portion and cooperating with the latter in forming a second guiding groove for receiving and guiding the other one of the rows of tape-mounted fastener elements, said spring engaging with said second gripping member to normally bias the latter toward said foot portion in a direction to narrow said second guide groove.

* * * * *